US006685582B2

(12) United States Patent
Abel

(10) Patent No.: US 6,685,582 B2
(45) **Date of Patent: *Feb. 3, 2004**

(54) WRIST TOY

(76) Inventor: Jeffrey T. Abel, 116 Westview Ct., Evanston, WY (US) 82930

( * ) Notice: Subject to any disclaimer, the term of this patent is extended or adjusted under 35 U.S.C. 154(b) by 0 days.

This patent is subject to a terminal disclaimer.

(21) Appl. No.: 10/116,838

(22) Filed: Apr. 5, 2002

(65) Prior Publication Data

US 2002/0173216 A1 Nov. 21, 2002

Related U.S. Application Data

(63) Continuation of application No. 08/699,152, filed on Aug. 16, 1996, now Pat. No. 6,368,241.

(51) Int. Cl.[7] ..... A63B 43/00
(52) U.S. Cl. ..... 473/508; 473/576
(58) Field of Search ..... 273/58 C, 414; 473/506, 508, 576

(56) References Cited

U.S. PATENT DOCUMENTS

| | | | | |
|---|---|---|---|---|
| 667,563 | A | * | 2/1901 | Oakley |
| 729,473 | A | * | 5/1903 | Wilson |
| 795,960 | A | * | 8/1905 | Cook |
| 1,782,254 | A | * | 11/1930 | Breidenbach |
| 2,142,068 | A | * | 12/1938 | Berger |
| 2,269,633 | A | * | 1/1942 | Merle |
| 3,031,191 | A | * | 4/1962 | Bonang |
| 3,531,115 | A | * | 9/1970 | Alexander |
| 3,635,476 | A | * | 1/1972 | Breslow et al. |
| 3,731,927 | A | | 5/1973 | Rocco, Jr. ..... 273/26 E |
| 3,785,643 | A | * | 1/1974 | Rich |
| 3,843,126 | A | * | 10/1974 | Bandy |
| 3,940,133 | A | * | 2/1976 | Civita |
| 4,042,241 | A | | 8/1977 | Collins ..... 273/95 A |
| 4,121,822 | A | * | 10/1978 | DiSabatino et al. |
| 4,147,353 | A | * | 4/1979 | Moore |
| 4,272,076 | A | * | 6/1981 | Song et al. |
| 4,346,902 | A | | 8/1982 | Warehime ..... 273/411 |
| 4,601,474 | A | * | 7/1986 | Lew et al. |
| 4,687,209 | A | * | 8/1987 | Carey |
| 4,753,442 | A | | 6/1988 | Bland ..... 273/414 |
| 4,836,554 | A | | 6/1989 | Robbins ..... 273/321 |
| 4,836,555 | A | * | 6/1989 | Wexler |
| 5,083,797 | A | * | 1/1992 | Vartija et al. |
| 5,094,462 | A | * | 3/1992 | Boyle et al. |
| 5,181,726 | A | | 1/1993 | Piaget ..... 273/414 |
| 5,401,034 | A | * | 3/1995 | Mallinger |
| 5,443,576 | A | | 8/1995 | Hauter ..... 273/58 C |
| 5,544,894 | A | | 8/1996 | Howard ..... 473/576 |
| 5,586,760 | A | | 12/1996 | Hauter ..... 273/58 C |

FOREIGN PATENT DOCUMENTS

| | | | |
|---|---|---|---|
| GB | 2263408 | * | 7/1993 |

* cited by examiner

*Primary Examiner*—John A. Ricci
(74) *Attorney, Agent, or Firm*—Fish & Richardson P.C.

(57) ABSTRACT

A toy which is formed from a wrist attachment part that attaches to a user's wrist, and has a ball attached to an elastic cord. The ball can be thrown and when it reaches the limit of elasticity of the cord, springs back. The cord can be formed from first and second elastic cords which are knotted together in a specified way. One of the cords passes through a hole in the ball, and forms a knot on the outside of the ball. The other cord that attaches to the first cord, and also coupled to the wrist attachment part. Protected sleeves can be used to cover the knots. The wrist attachment part may be formed of Velcro, so that it can adjust in size to attach around the user's wrist.

40 Claims, 2 Drawing Sheets

WRIST TOY

This application is a continuation of U.S. application Ser. No. 08/699,152 filed Aug. 16, 1996 now Pat. No. 6,368,241.

BACKGROUND OF THE INVENTION

1. The Field of the Invention

The apparatus of the present invention is a toy. In particular, a toy employing an elastic cord configured to minimize contact and abrasion of the elastic cord with the intended surface and employing means for preventing the elastic cord from knotting or twisting.

2. The Relevant Technology

Several tethered balls and recreational devices exist. U.S. Pat. No. 3,940,133 teaches an elastic cord attached to ball using an embedded socket member in one end of the ball. The attachment to the ball employs a pivot mount.

U.S. Pat. No. 5,094,462 teaches a tethered soccer ball. A net is employed to surround the ball and to which an elastic cord is secured.

U.S. Pat. No. 3,843,126 teaches a tethered ball. An elastic band is attached at one end to a ball and on the other end to a flattened portion of a glove covering the palm and the back of the hand.

U.S. Pat. No. 4,836,555 teaches a combination glove and slap ball. A rubber band is attached at one end to a ball and to the other end to a disk anchor removably disposed in the glove.

U.S. Pat. Nos. 2,269,633 and 2,142,068 teach a toy. The toy employs an elastic strand attached at one end to a ball and attached at the other end to a disc or plate. A stirrup secured to the disc or plate is configured to receive the hand of the user.

U.S. Pat. No. 3,031,191 teaches a tethered ball game. A rubber band is secured at one end to a ball and is secured at the other end to a handle gripped by the user.

U.S. Pat. No. 3,635,476 teaches a pivotable target and ballstriking means. The ballstriking means comprises a ball which is connected to an elastic strand. The elastic strand is connected to a ringlike hand-clasping member.

U.S. Pat. No. 4,147,353 teaches a soccer ball retriever. The retriever includes an anchor stake, a cord and a ball holder. The cord comprises an elastic member and a braided nylon member. The cord is disposed between the ball holder and the anchor. A hook and swivel connect the cord to the anchor stake.

U.S. Pat. No. 4,601,474 teaches a self-retrieving attack ball. A spool rotatable about a shaft is disposed with the ball. Two spiral springs act against the spool. A cord is wound about the spool such that when the ball is thrown and the free end of the cord is retained, the cord unwinds from the spool, when the momentum of the ball no longer overcomes the spiral springs, or when the ball strikes an object, the spiral springs recoil the spool winding the cord up inside the ball.

U.S. Pat. No. 5,083,797 teaches a game ball training apparatus/carrier. The apparatus include a handle, an inelastic cord and an inelastic ball net. The inelastic cord is fastened at one end to the handle and the other end is looped through the net.

What is needed is a simplified construction of a wrist toy with a retrievable ball to develop eye-hand coordination. What is needed is a construction which minimizes the size and weight of the elastic cord member without sacrificing length to permit the ball to be thrown and to rebound with minimal interference from the elastic cord. What is also needed is an apparatus whose structural configuration minimizes the wear of the elastic cord while providing direct attachment of elastic members to the ball. It would also be desired to provide means for preventing the entire length of the elastic from twisting thereby avoiding knotting.

SUMMARY AND OBJECTS OF THE INVENTION

The present invention is directed to a novel retrievable toy. The ball can be thrown against walls or floors or simply to a distance until the length of the elastic cord causes the ball to rebound. The toy is directed to development of eye-hand coordination That is, the present invention is directed to a toy which is preferably thrown and caught by the same hand.

In order to provide structure to facilitate eye-hand coordination, the materials of construction, the size of the ball and component parts, the interrelation and position of the component parts, and the location of the component parts vis-a-vis the hand are important features of the present invention. The present invention is directed to minimizing interference caused by the cord when the ball is thrown and during the rebound travel of the ball. Because the ball of the present invention can and does strike wall and/or floors, it is also important to provide a construction which will minimize degrading wear of the elastic cord. All these objectives are met by the present invention.

The present invention is directed to a wrist toy comprising a wrist band, an elastic cord member and a ball. The elastic cord member is attached directly to the ball employing means for minimizing contact of the elastic cord with the floor or wall. The wrist band comprises a webbed band secured about the limb of the user. The wrist band is provided with means for receiving the elastic member and for avoiding or minimizing the twisting or knotting of the entire length of the elastic cord and ball.

In a preferred embodiment, the means for minimizing contact of the elastic cord with the floor or wall is accomplished by passing the elastic member directly through only a portion of the ball, not necessarily through the center or along a central axis of the ball. A preferred structure of the means to avoid or minimize the twisting or knotting of the entire length of the elastic cord and ball employs a freely rotating swivel releasably connected to the wrist band. A novel feature of the present invention is the position of the freely rotating swivel located on the wrist of the user so as to be at the base of the hand of the user.

An advantage and object of the present invention over the cited prior art is that the rebounding of the ball is directed to the hand of the user while avoiding or minimizing the twisting or knotting of the entire length of the elastic member.

Another object of the present invention includes minimizing the degrading or wear contact of the apparatus with the floor or wall.

Still another object of the present invention is to minimize interference of the flight or rebounding of the ball.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
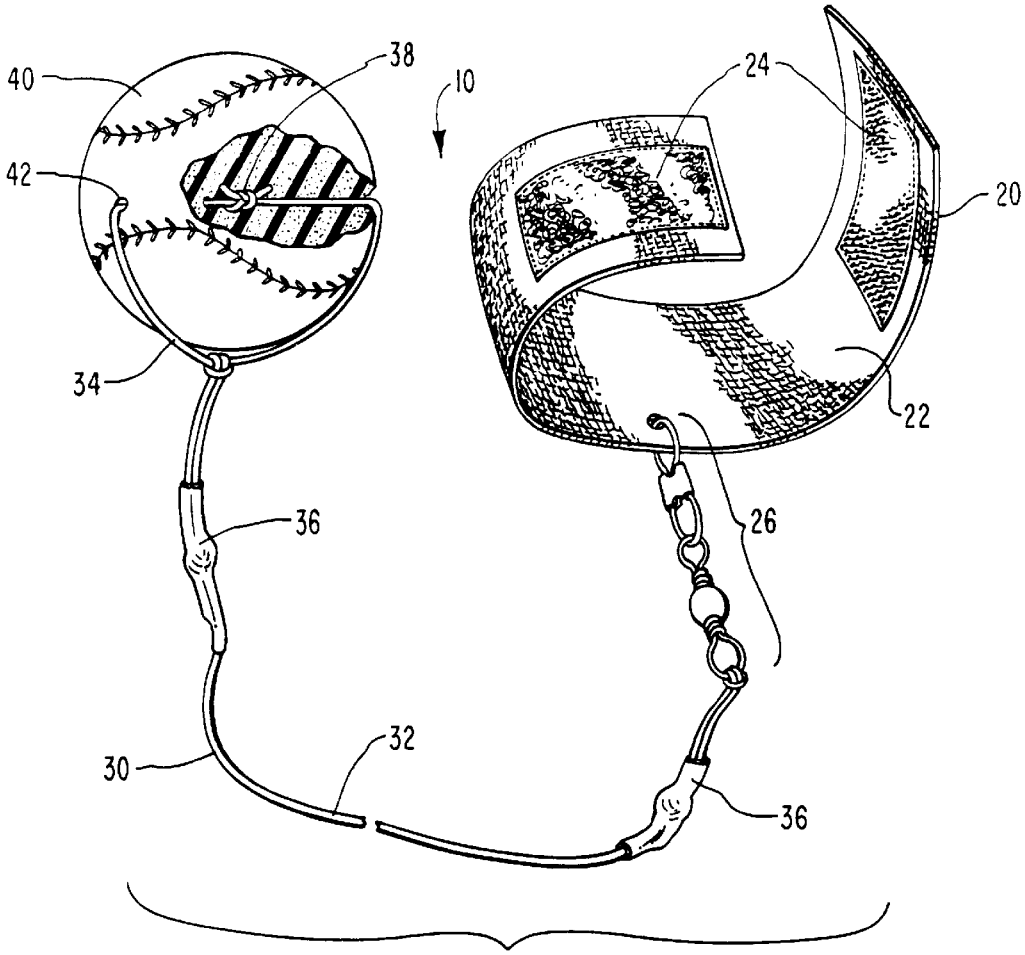
FIG. 1 is a perspective view of one embodiment of the retrievable toy of the present invention.

In the drawings a preferred embodiment 10 of the toy apparatus is shown. Apparatus 10 comprises wrist band 20, elastic member 30 and ball 40.

Wrist band 20 comprises a length of Nylon (™) synthetic polyamide webbing 22 to encircle the limb of the user. Means 24 for fastening wrist band 20 may include any conventional fastening means. FIG. 1 illustrates the use of conventional hook and pile fastening means. Hook and pile is preferred because it as adjustable to different size wrists. Snaps, buttons or other adjustment of fastening means may provide equivalent function.

Wrist band 20 also comprises means for avoiding or minimizing the twisting or knotting of the entire length of the elastic cord and ball. The preferred embodiment of the means for avoiding or minimizing the twisting or knotting of the entire length of the elastic cord comprises a freely rotatable swivel 26. Swivel 26 is releasably attachable to webbing 22. In order to optimize the rebound of ball 40 to the hand of the user, swivel 26 is attached to an edge of webbing 22. This provides the user with the advantage of being able to wear wrist band 20 such that swivel 26 is positioned just at the base of the user's palm. Attaching swivel 26 at the edge of webbing 22 also advantageously minimizes any interference of the rotating action of swivel 26 and, hence, of the entire length of elastic member 30.

Figure 2:
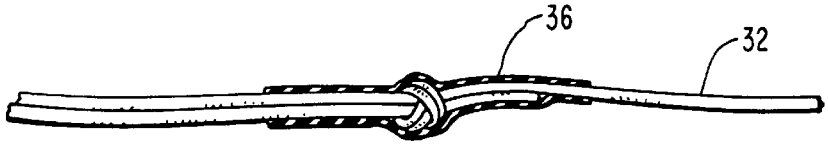
FIG. 2 is a detailed view of a transition length of an elastic band employed by the present invention.

Elastic member 30 comprises two members, elastic rebounding cord member 32 and means 34 for minimizing contact of the elastic cord with the floor or wall. Elastic cord 32 provides the retrieving, rebounding effect needed. Cord 32 is attached directly to swivel 26 at one end and to the means 34 for minimizing contact of the elastic cord with the floor or wall at the other end. To optimize the endurance of cord 32 and to prevent any scratching to the user, sleeve 36 may shroud the knots and ends of cord 32. FIG. 2 shows one embodiment of how sleeve 36 shrouds the knots and ends of cord 32.

Figure 3:
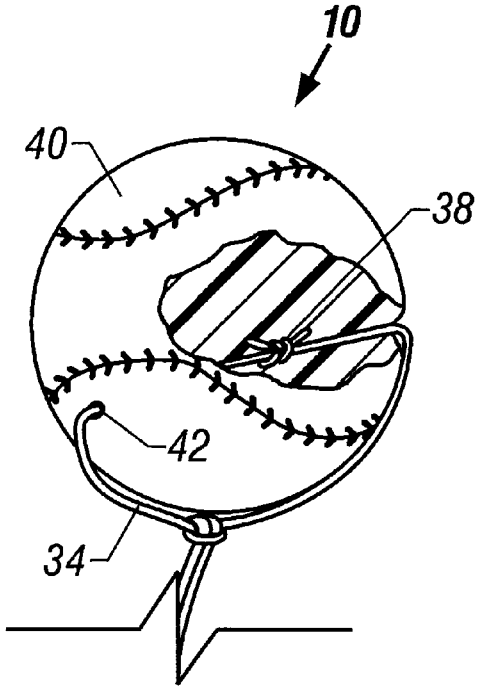
FIG. 3 is a detailed view of the retrievable toy with the cord passing through an of if center axis of the ball.

The preferred embodiment of means 34 for minimizing contact of the elastic cord with the floor or wall comprises attachment member 34. Attachment member 34 may be made of the same material as cord 32. However, the preferred embodiment of attachment member 34 comprises a flat elastic construction so that it lies flatter against ball 40. Attachment member 34 is connected to ball 40 by passing a portion of attachment member 34 and to draw knot 38 inside ball 40. Bore 42 may pass through an axis of ball 40. However, in the preferred embodiment, bore 42 passes through a portion of ball 40 not along an axis of ball 40 such that a larger continuous surface of ball 40 is free of the attachment member 34, thereby minimizing the contact of attachment member 34 with contact surfaces such as floors and/or wall. This alternative embodiment is shown in FIG. 3. In this way, when thrown, a larger mass of the ball is the leading portion of ball 40 which ultimately contacts a floor or wall thereby minimizing contact of attachment member 34 or cord 32 with a floor or wall.

Ball 40 comprises any ball. Preferably ball 40 comprises a rubber or spongy ball which can be adapted with a bore 42 to receive member 34. For example, ball 40 can be made of a soft material which deforms upon impact to absorb impact energy but which material is sufficiently elastic such that the ball after impact and recoil transforms back to its preimpact shape. Preferably ball 40 is of a weight which when thrown is not significantly hindered by elastic member 30.

It will be appreciated that wrist band 20, elastic member 30 and ball 40 may be manufactured in any color or combination of colors as desired.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus, comprising:

a wrist attachment part, having inner surfaces adapted for pressing against a user's wrist;

a spherical ball, having a hole therethrough extending across an arc thereof, defined between outer surfaces of the spherical ball;

a first elastic cord, coupled to said wrist attachment part at one end, and having a second end, distant from said one end;

a second elastic cord, extending through said hole in said spherical ball, and having a knotted portion on an outside surface of said spherical ball defining a first section of cord on one side of said knotted portion which passes through said hole in said spherical ball, and another side of said knotted portion being coupled to said second end of said first elastic cord.

2. An apparatus as in claim 1, further comprising a knot between said first elastic cord and said second elastic cord.

3. An apparatus as in claim 2, further comprising a protective sleeve, covering said knot and at least one free end of said first and second elastic cords.

4. An apparatus as in claim 1, further comprising a swivel, connected between said wrist attachment part and said first elastic cord.

5. An apparatus as in claim 1, wherein said first elastic cord is directly connected to said wrist attachment part.

6. An apparatus as in claim 1, further comprising a third elastic cord, connected to said wrist attachment part at one end, and connected to said first elastic cord at a second end.

7. An apparatus as in claim 6, further comprising a second knot between said first elastic cord and said third elastic cord.

8. An apparatus as in claim 7, further comprising a protective sleeve, covering said second knot and at least one free end of said first and third elastic cords.

9. An apparatus as in claim 7, wherein said hole extends through substantially a center portion of said spherical ball.

10. An apparatus as in claim 1, wherein said wrist attachment part has an adjustable size.

11. An apparatus as in claim 10, wherein said wrist attachment part is formed of hook and eye type attachable material.

12. An apparatus as in claim 1, wherein said second elastic cord comprises a section of elastic cord with a connecting knot inside said hole in said spherical ball, extending to two ends of said spherical ball, to said knotted portion outside said spherical ball, and wherein said another end comprises two portions of said second elastic cord.

13. An apparatus, comprising:

a spherical ball, having a hole extending therethrough;

a first connecting cord, having a first knot which is located inside said hole, two portions of said first connecting cord extending on an outside of said spherical ball, and having a second knot, on said outside of said spherical ball where said two portions of said first connecting cord meet one another, said knot securing said two portions of said first connecting cord relative to said spherical ball, and having a second cord portion extending from said second knot;

a first elastic cord, connected to said second end of said first connecting cord at a first end of said first elastic cord, and having a second end opposite said first and; and a wrist attachment mechanism, having a connection part which couples to said second end of said first elastic cord.

14. An apparatus as in claim 13, wherein said spherical ball is formed of a spongy material.

15. An apparatus as in claim 13, wherein said connection part includes a hole in said wrist attachment mechanism.

16. An apparatus as in claim 15, further comprising a swivel mechanism, coupled between said hole in said wrist attachment mechanism and said first elastic cord.

17. An apparatus as in claim 15, wherein said first elastic cord is connected directly to said hole in said wrist attachment mechanism.

18. An apparatus as in claim 13, wherein said first connecting cord and said first elastic cord are connected together by a third knot.

19. An apparatus as in claim 18, further comprising a protective sleeve, covering said third knot and free ends of said first connecting cord and said first elastic cord.

20. An apparatus as in claim 13, wherein said hole extends through substantially a center diameter of said ball.

21. An apparatus as in claim 13, wherein said hole extends through a non center arc of said ball.

22. An apparatus as in claim 13, wherein said first connecting cord is formed of an elastic material.

23. An apparatus as in claim 13, wherein said wrist attachment mechanism has a variable size.

24. An apparatus, comprising;

a spherical ball formed of a spongy material with a bore therein extending between two outer surfaces of said spherical ball;

a first connecting cord, having a first portion extending through said bore with two portions of said cord extending on respective sides of said spherical ball and around an outer surface of said spherical ball to one another, with a first knot being formed at a portion where said two portions of said first connecting cord meet one another, adjacent said outer surface of said spherical ball, and having an extending part formed by said two portions which extend from said first knot;

an first elastic cord, having a first end which is connected by a second knot to said two portions of said first connecting cord; and a wrist holding part, formed of a strap with surfaces to hold a users wrist, and having a connection part therein, said elastic cord being coupled to said connection part.

25. An apparatus as in claim 24, wherein said bore extends through a central diameter axis of said spherical ball.

26. An apparatus as in claim 24, wherein said bore extends through and off center axis of said spherical ball.

27. An apparatus as in claim 24, wherein said connection part on said wrist holding part includes a hole formed in said wrist holding part.

28. An apparatus as in claim 27, wherein said connection part further comprises a swivel mechanism, coupled to said hole in said wrist holding part.

29. An apparatus as in claim 24, wherein said connection part includes a swivel mechanism coupled to said hole in said wrist holding part.

30. An apparatus as in claim 24, further comprising a sleeve, covering said knot between said elastic cord and said first connecting cord.

31. An apparatus as in claim 24, wherein said wrist holding part includes a hook and eye type attachable mechanism for adjusting a size thereof.

32. An apparatus as in claim 24, further comprising a second elastic cord, coupled between said first elastic cord and said connection part.

33. An apparatus as in claim 22, wherein said first elastic cord and said second elastic cord are coupled together by a third knot.

34. An apparatus as in claim 33, further comprising a sleeve covering said third knot and covering free ends of said first elastic cord and said second elastic cord.

35. An apparatus, comprising:

a spherical ball, formed of an elastic material, and having a bore therein, extending between two outer surfaces of said spherical ball;

a wrist attachment mechanism, having inner surfaces which can be changed in shape to attach to a users wrist, and having a connection part, enabling connection to said wrist attachment mechanism, said wrist attachment mechanism formed of a flexible material, and said connection part including a rigid portion;

a first elastic cord, coupled between said rigid connection portion and said spherical ball, and including at least one connection knot therein which connects different parts of said first elastic cord to one another, said at least one connection knot including a sleeve covering an outer surface of the connection knot.

36. An apparatus as in claim 35, wherein said rigid connection part includes a rigid swivel.

37. An apparatus as in claim 35, wherein said sleeve also covers an end portion of said first elastic cord.

38. An apparatus as in claim 37, further comprising a connection cord, connected through said bore of said spherical ball, and connected to said first elastic cord at said connection knot.

39. An apparatus as in claim 38, further comprising a second knot, in said connection cord, at an area where two parts of said connection cord contact with one another on an outside of said ball.

40. An apparatus as in claim 35, further comprising a second elastic part, coupled by a second knot to said connection part at a first end, and coupled by a third knot to said first elastic cord at a second end, and a second sleeve, covering a free end of said second elastic part, a free end of said first elastic part, and said third knot.

* * * * *